US010287065B2

(12) United States Patent
Widmer et al.

(10) Patent No.: US 10,287,065 B2
(45) Date of Patent: May 14, 2019

(54) TAMPER EVIDENT CLOSURE CAP, CONTAINER AND COMBINATION THEREOF

(75) Inventors: Sebastien Cedric Widmer, Landser (FR); Lino Dreyer, Rixheim (FR); Philippe Gerard Odet, St. Georges de Reneins (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 487 days.

(21) Appl. No.: 12/524,308

(22) PCT Filed: Jan. 9, 2008

(86) PCT No.: PCT/EP2008/050184

§ 371 (c)(1),
(2), (4) Date: Jul. 23, 2009

(87) PCT Pub. No.: WO2008/092716

PCT Pub. Date: Aug. 7, 2008

(65) Prior Publication Data

US 2010/0032402 A1 Feb. 11, 2010

(30) Foreign Application Priority Data

Jan. 31, 2007 (EP) ..... 07101504

(51) Int. Cl.
*B65D 41/34* (2006.01)

(52) U.S. Cl.
CPC ..... *B65D 41/3409* (2013.01); *B65D 41/3428* (2013.01); *B65D 41/3447* (2013.01)

(58) Field of Classification Search
USPC ..... 215/252, 253, 258
See application file for complete search history.

(56) References Cited

U.S. PATENT DOCUMENTS

| | | | | | |
|---|---|---|---|---|---|
| 4,153,174 | A | * | 5/1979 | Keeler | 215/252 |
| 4,402,418 | A | * | 9/1983 | Ostrowsky | 215/252 |
| 4,546,892 | A | * | 10/1985 | Couput B65D 41/0414 | 215/252 |
| 4,560,076 | A | * | 12/1985 | Boik | 215/252 |
| 4,629,082 | A | * | 12/1986 | Badia Iniesta | 215/252 |
| 4,732,289 | A | | 3/1988 | Granat et al. | |
| 4,785,963 | A | | 11/1988 | Magley | |

(Continued)

FOREIGN PATENT DOCUMENTS

| | | |
|---|---|---|
| CH | 599004 | 5/1978 |
| DE | 29502309 | 6/1999 |

(Continued)

*Primary Examiner* — Jeffrey R Allen
(74) *Attorney, Agent, or Firm* — Davis & Bujold PLLC; Michael J. Bujold

(57) ABSTRACT

The invention relates to a tamper evident closure cap (101). A tamper evident band is provided with an extension (107) having an upper edge (113) extending above an engagement surface (110) of a projection (109). The extension (107) and the projections (109) are arranged on an annular, circumferentially running band (105). When the closure is applied to a container, the extension (107) is clamped between the inner surface (114) of the tamper evident band or the closure and a retaining structure on a container finish.

9 Claims, 10 Drawing Sheets

(56) References Cited

U.S. PATENT DOCUMENTS

| | | | | | |
|---|---|---|---|---|---|
| 4,801,030 | A | | 1/1989 | Barriac | |
| 4,875,594 | A | * | 10/1989 | Ochs | 215/252 |
| 4,957,211 | A | * | 9/1990 | Ekkert et al. | 215/230 |
| 5,111,949 | A | * | 5/1992 | Ambrosi et al. | 215/313 |
| 5,320,233 | A | * | 6/1994 | Welch | 215/252 |
| 5,695,083 | A | * | 12/1997 | Obadia | 215/329 |
| 5,950,850 | A | * | 9/1999 | Takamatsu et al. | 215/252 |
| 6,766,917 | B1 | * | 7/2004 | Blewitt, III | 215/252 |
| 7,344,039 | B2 | * | 3/2008 | Bixler et al. | 215/252 |
| 7,775,386 | B2 | * | 8/2010 | Falzoni | 215/252 |
| 7,878,351 | B2 | * | 2/2011 | Falzoni et al. | 215/252 |
| 2005/0072751 | A1 | | 4/2005 | Price et al. | |
| 2005/0189312 | A1 | | 9/2005 | Bixler et al. | |
| 2006/0021959 | A1 | * | 2/2006 | Falzoni | 215/252 |
| 2006/0060555 | A1 | | 3/2006 | Ma et al. | |
| 2006/0283828 | A1 | * | 12/2006 | Falzoni et al. | 215/200 |
| 2010/0032402 | A1 | * | 2/2010 | Widmer et al. | 215/252 |

FOREIGN PATENT DOCUMENTS

| | | |
|---|---|---|
| EP | 697343 | 2/1996 |
| GB | 2116155 | 9/1983 |
| GB | 2385321 | 8/2003 |

* cited by examiner

TAMPER EVIDENT CLOSURE CAP, CONTAINER AND COMBINATION THEREOF

This invention relates generally to the field of packaging technology, and in particular to tamper evident closure caps comprising a top panel and a cylindrical skirt depending from the periphery of the top panel, to containers and to combinations thereof.

Such tamper evident closure caps for bottles and other resealable containers are provided with some form of tamper-evident feature, which are designed to make it apparent to a consumer that a container has been opened. Many conventional tamper evident closures utilise what is known as a tamper evident band. Commonly, the tamper evident band with its upper edge is frangibly connected to the open end of the skirt portion of the closure by a line of weakness, for example, frangible bridges or a scored line. The tamper evident band rests beneath a retaining structure, such as an annular retaining ledge, on the container finish and the retaining structure is located below a threaded section of the container finish.

A retaining element such as a radially inwardly directed band, folded flaps or protruding elements on the interior of the tamper evident band prevents the tamper evident band from being removed due to engagement of the retaining element with the retaining structure on the container when the closure is unscrewed for removal. This means that there is some resistance to unscrewing of the closure, until the line of weakness or bridges fracture, consequently allowing easy removal of the closure, with the tamper evident band remaining in position below the retaining structure and indicating that the closure has been opened.

In case the retaining element is formed by an inwardly directed flange or folded flaps the design of the element is preferably such that when an upwardly axial force is applied to the tamper evident band the flaps or the band do not flip such that the tamper indicating band can pass back over the container retention bead. In addition, the flaps or the band must be flexible enough to pass over the retention structure when the cap is first applied to the container.

This is achieved, for example, by the use of extensions of the flaps, as shown for example in U.S. Pat. No. 4,546,892, which extend above the level of the retaining structure of the container when the closure is in its fully screwed on position. These extensions may be clamped between the retaining structure and the inside wall of the tamper indicating band when the closure cap is screwed on the container, and prevent the flaps from flipping down.

Additionally or alternatively to a retaining structure which becomes effective upon an axial force there are known tamper evident bands which comprise anti-rotational means which are adapted to act with a corresponding element on the container neck in circumferential direction.

In each case there is some resistance to unscrewing of the closure cap, until the line of weakness fractures.

Usually, the line of weakness breaks in case of a regular attempt to open the container. But the tamper indicating band should also indicate if there had been an irregular attempt, for example if somebody uses a tool to lift the tamper indicating band from the retaining element of the container neck in order to prevent breaking of the frangible connection.

There is also a danger that the line of weakness could stay intact although the sealing of the closure cap had been disengaged by slightly and slowly opening of the closure and a liquid transfer might become possible. Hazardous material could be sucked into a container although the closure cap had not been removed in an ordinary way and the line of weakness is still unbroken.

Thus there is a requirement in the packaging industry to provide some form of tamper evident closures which also indicates such a sabotage act. It should be difficult if not impossible for the contents of the containers to be manipulated or otherwise tampered without it being immediately apparent to a user. The present invention seeks to provide a closure in which the line of weakness breaks before the closure is substantially opened, for example before the sealing is released.

According to one aspect of the present invention the tamper evident band has at its lower edge a hingedly connected annular retaining band. The annular retaining band extends radially inwardly and towards the top panel when the cap is in the screwed on position.

The annular retaining band has at least one projection with a closure-engagement surface. When the closure cap is screwed onto the container the projection extends radially towards the inside of the closure cap so as to engage under an engagement surface of a retaining structure, which is arranged on the container neck.

The annular retaining band has at least one axial extension, preferably an annular band, having an axial length selected such that its free edge extends at least axially above the engagement surface of the retaining structure when the cap is in its screwed on position. The axial distance from the lower edge of the tamper indicating band to the closure engagement surface of the at least one projection thus is smaller than the axial distance from the lower edge of the tamper indicating band to the free edge of the axial extension.

Since the axial length of the annular retaining band including the axial extension is longer than the axial distance between the lower edge of the tamper indicating band and the closure engagement surface, in a screwed on position the free edge of the extension is at least above the axial level of the retaining structure. The flexible extension thus can be clamped between the inner wall of the closure cap and the retaining structure, which prevents the annular band from bending down similar as shown in U.S. Pat. No. 4,546,892.

The annular band, preferably a flange, has basically the same radial thickness all around its circumference. Bending downward the complete flange is, however, more difficult than bending down individual flaps. Hence the at least one projection being arranged on the annular band has a stable substructure and can't easily be bent downwards at one or more individual points.

The projection also can have the form of a circumferential annular bead, which makes an improper opening attempt even more difficult. Alternatively one or more single projections can be arranged around the annular band making inward folding of the band from its downward, as moulded position easier. Preferably each projection is combined with an axial extension, more preferably the axial extension is also an annular band, such that the force preventing the flipping down of the retaining band is equally distributed around the circumference, when the closure cap is in its screwed on position.

The opening angle for breaking the frangible line can be decreased by a tamper indicating band additionally comprising at least one anti-rotational element adapted to engage a corresponding element on a container neck in circumferential direction. Preferentially the at least one anti rotational element is arranged on the least one axial extension. It may thus engage with a corresponding engagement surface on a container neck.

According to another aspect of the present invention the tamper evident band has at its lower edge a hingedly connected retaining element, preferably an annular band, which extends radially inwardly and towards the top panel when the cap is in the screwed on position.

At least one projection with a closure engagement surface is arranged on at least one of the retaining elements or on the retaining element. When the cap is in the screwed on position, the projection extends radially towards the inside of the cap so as to engage under the engagement surface of a retaining structure circumferentially arranged on a container neck. At least one of the retaining elements has one axial extension having an axial length selected such that its free edge extends axially above an engagement surface of a retaining structure when the cap is in its screwed on position. Thus the axial distance from the lower edge of the tamper indicating band to the closure engagement surface of the at least one projection is smaller than the axial distance from the lower edge of the tamper indicating band to the free edge of the axial extension.

Furthermore, at least one anti-rotational element is arranged on at least one of the axial extensions. The anti-rotational element is adapted to engage a corresponding element on and/or above the retaining structure in circumferential direction when the closure cap is in its screwed on position.

This means that the engagement surface of the anti rotational element in the screwed on position is above the engagement surface of the projection. The axial distance between the lower edge of the tamper indicating band and the engagement surface of the projection is smaller than the axial distance between the lower edge of the tamper indicating band and the effective surface of the anti rotational element.

The closure cap according to this aspect of the invention in particular provides three elements which in combination secure the closure cap against improper opening.

The first element is the axial extension. When the closure cap is applied to the container the at least one axial extension is located between the retaining structure of the container and the inner wall of the closure cap and prevents flipping down of the inwardly bended retaining elements.

The second element is the at least one projection which causes an axial force on the frangible lines upon opening of the closure.

The third element is the at least one anti-rotational element causing a circumferential force on the frangible line upon opening. Since the anti-rotational element is arranged on the axial extension, the third element also supports and improves the effect of the first element and further prevents the retaining element from flicking down in case of an improper opening attempt.

Preferably all three elements are distributed evenly around the circumference of the closure cap.

In one preferred embodiment of the invention the retaining element is an annular band, preferably with a basically constant radial thickness around the circumference. In this embodiment the retaining element may have only one axial extension formed as an annular band, too.

Alternatively the retaining elements may take the shape of individual flaps, which might be connected by a web or connection elements with a smaller radial thickness. Retaining elements formed as flaps can easily pass over the retaining structure when the closure cap is applied to the container.

In a preferred embodiment of the invention each of the retaining elements comprises at least one axial extension. Thus none of the retaining elements can be forced in a downward direction when the closure cap is in the screwed on position.

In another preferred embodiment of the invention each of the retaining elements comprises at least one radial projection.

In a further preferred embodiment of the invention each of the retaining elements comprises at least one anti-rotational element.

Preferably one or more retaining elements have at least a combination of an axial extension and a projection or a combination of an anti-rotational element and a projection.

In a further preferred embodiment of the invention the axial length of the tamper indicating band (i.e. the distance between its lower edge and the frangible line) is smaller than the axial distance between the lower edge of the tamper indicating band and the free edge of the axial extension, such that the free edge of the axial extension extends up to the inner wall of the cylindrical skirt when the cap is in the screwed on position.

When the closure cap is applied to the container, especially when the tamper indicating band passes over the retaining structures of the container, there are radial forces on the frangible connection between the tamper indication band and the skirt part of the closure cap. The connection, for example bridge elements or a line of weakness, may prematurely break completely or partially in this situation. Advantageously the tamper indicating ring is thus restrained to be bent outwardly around the frangible line. When the extension is supported by the inner surface of the skirt, the frangible line is shielded from radial forces caused by the retaining structure.

According to another aspect of the present invention the tamper evident band has on its inside wall at least one projection with a closure engagement surface. When the cap is in the screwed on position the at least one projection engages under an engagement surface of a retaining structure circumferentially arranged on a container neck.

The tamper evident band has on its inside wall at least one anti-rotational element that is adapted to engage a corresponding element on and/or above the retaining structure in circumferential direction. Thus the axial distance from the lower edge of the tamper indicating band to the closure engagement surface of the at least one projection is smaller than the axial distance from the lower edge of the tamper indicating band to the upper edge of the anti-rotational element.

This aspect concerns closure caps with a solid tamper evident band rather than with an inwardly bended retaining ring or element. Nevertheless also these caps bear the risk of being improperly opened, for example by lifting the tamper indication band or by slowly opening the closure such as to disengage a seal without breaking the frangible line.

The closure cap according to this aspect of the present invention reduces the opening angle necessary for breaking the frangible line.

Irrespective of whether the projection and the anti-rotational element is placed on a hingedly connected retaining element, on a surrounding retaining band or directly on the inner wall of the tamper evident band, in a preferred embodiment at least one anti-rotational element is positioned next to the projection in a circumferential distance.

For example on a retaining band projections and anti-rotational elements can be alternately arranged in circumferential direction or in the angular range between two projections there are two or more anti-rotational elements.

Alternatively or additionally an anti-rotational element can be connected directly to the projection. The anti-rotational element can be placed directly above or adjacent to the projection, such that axial and anti-rotational forces apply close-by.

Irrespective of the detailed layout of the closure cap in a preferred embodiment the at least one anti-rotational element has a ratchet surface adapted to engage with a corresponding surface on the container.

In a further preferred embodiment the at least one anti-rotational element has a ramp with a smooth surface in axial direction, which in use points downwards, to facilitate the application of the closure. This is particular beneficial for the application of the closure onto the container in case the anti-rotational element is not located right above a projection, which favourably has a correspondent ramp. The ramp eases passing of the closure over the threads and the retaining structure of the container.

Also irrespective of the detailed layout of the closure cap, in a preferred embodiment the at least one projection has a pocket, which opens towards the top panel when the closure cap is screwed on. When the closure cap is applied to the container and the projection has to pass over the threads and or the retaining structure there is a radial force to the inner wall of the projection. Due to the pocket the projection may be deformed radially outwardly. The projection is elastical so that the projection returns back to its original form, when it has passed the retaining structure to engage under the retaining structure.

The pocket can have the form of a groove or an undercut.

According to a further aspect of the invention there is provided in combination, a closure cap with an annular retaining band, preferably as described above, and a container neck. The container neck has a circumferentially arranged retaining structure with at least one engagement surface.

Upon opening the closure engagement surface of the at least one projection arranged on the retaining band of the closure engages under the at least one engagement surface of the retaining structure, while the extension of the closure is clamped between the retaining structure of the container and the inner surface of the closure.

According to a further aspect of the invention there is provided in combination, a closure cap with a projection and an anti-rotational element, preferably as described above, and a container neck. The container neck comprises a circumferentially arranged retaining structure with at least one engagement surface and at least one circumferential stopper element arranged on or above the retaining structure.

When the cap is screwed off the closure engagement surface of the at least one projection engages under the at least one engagement surface of the retaining structure and the at least one anti-rotational element of the closure cap engages with the at least one stopper element in circumferential direction.

According to another aspect of the invention there is provided a container finish comprising a plurality of stopper elements adapted to engage with anti-rotational elements on a closure cap. There is at least one first group of protruding stopper elements, where each stopper element has a ratchet surface in circumferential direction. The stoppers of this first group are arranged in a limited section of the circumference of the container. At least one second group of radial projections without ratchet surface is arranged in a further limited section of the circumference.

The maximal radial extension of the stopper elements is basically equal to those of the projections.

The final shape of the container finish is determined by the mould of the container preform. The mould formed of two mold parts can easily be opened if no surface on the container finish obstructs the opening process, preferably if all surface normals include an angle of less than 90 degree with the opening direction, in which the mould is moved.

Therefore especially stopper elements with ratchet surfaces are only arranged in a limited section of the circumference, such that demoulding is facilitated.

Preferably the surfaces of all other radial surfaces, especially those of the projections and of the back surface of the stopper elements, are flat or concave.

When a closure cap is applied to the container, the stopper elements engage with anti-rotational elements of the tamper indicating band. These anti-rotational elements generally are basically distributed equally around the tamper indicating band.

The projections of the second group, which have basically the same maximal radial extension, stabilize and centre the tamper indicating band in those sections, where the anti-rational elements do not engage the stopper elements. They provide for a stable circular shape of the tamper indicating band and a uniform distribution of the circumferential force to the entire line of weakness.

Favourably there are two first groups of stopper elements symmetrically arranged on the circumference of the container finish. Preferably each of the first groups is bordered by second groups of projections.

When the mould is opened, in the vicinity of the separation or demoulding plane, where the generally two moulds meet during moulding, it might be difficult even to form concave surfaces. In a favourable embodiment of the invention thus the vicinities of the demoulding plane are free from any stopper elements or projections. These areas might be shaped as cylinder surfaces or as flat surfaces, with normals perpendicular to the separation direction.

The present invention will now be more particularly described by way of example, with reference to the accompanying drawings, in which FIG. 1 is a cross section through of a first embodiment of the invention;

FIG. 2 is a cross section through of a second embodiment of the invention;

FIG. 3: is a cross section through of a third embodiment of the invention;

FIG. 4: is a cross section through of a fourth embodiment of the invention;

FIG. 5: is a cross section through of a fifth embodiment of the invention;

Figure 1:
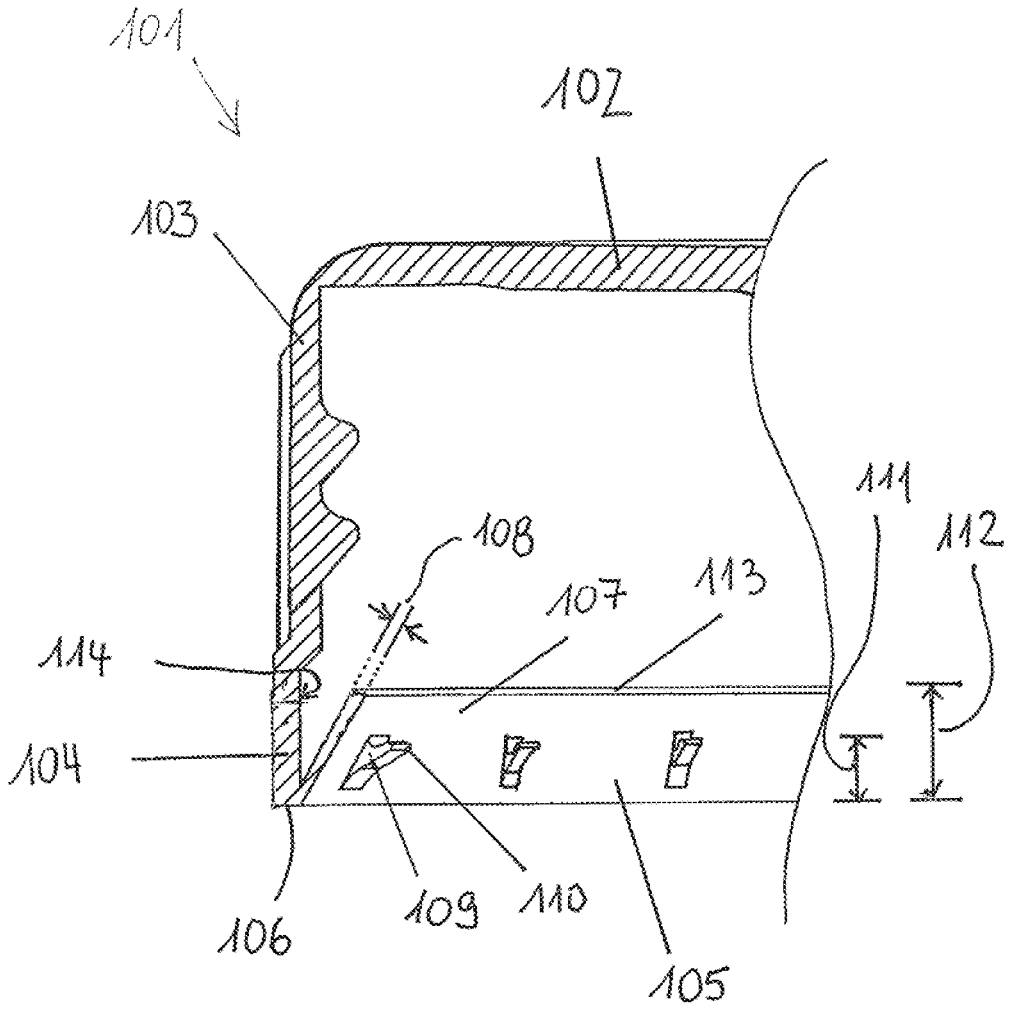

FIG. 1 shows a first example of a closure cap 101. The closure cap 101 comprises a top panel 102 and a cylindrical skirt 103. At the lower end of the skirt 103 a tamper indicating band 104 is frangibly connected. An annular retaining band 105 extending over the complete circumference is hingedly connected to the lower edge 106 of tamper indicating band 104. The annular retaining band 105 has an axial extension 107, which is formed as an annular band. The annular retaining band 105 and the axial extension 107 have the same radial thickness 108 all around the whole circumference.

On the annular retaining ring 105 there are projections 109 with engagement surfaces 110 which are adapted to engage under a retaining structure of a container not explicitly shown in the figure. The axial distance 111 from the lower edge 105 of the tamper indicating band 104 to the closure engagement surface 110 of the projections 109 is smaller than the axial distance 112 from the lower edge 106 of the tamper indicating band 104 to the free edge 113 of the axial extension 107. Thus when the closure cap 101 is screwed on the container (see also FIG. 6) the axial extension 107 is on or above the axial level of the retaining structure and located between the retaining structure and the inner wall 114 of the closure cap 101.

Figure 2:
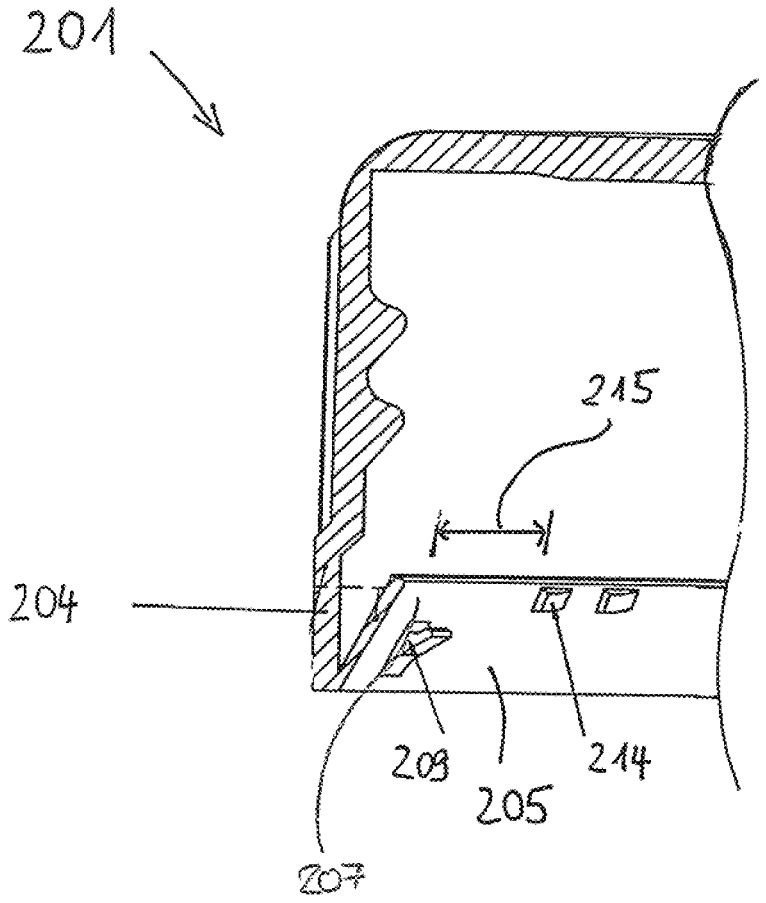

FIG. 2 shows a second example of a closure cap 201. The tamper indicating band 204 is provided with a hingedly connected retaining element 205, in this example formed as an annular band. The retaining element 205 is extended by an axial extension 207, in this example also shaped an annular band. On the retaining element 205 there are projections 209, from which only one is shown in this figure. On the axial extension 207 there are anti-rotational elements 214, two of which are shown in this figure.

The anti-rotational elements 214 are arranged neighbouring to the projection 209 in a circumferential distance 215.

Figure 3:
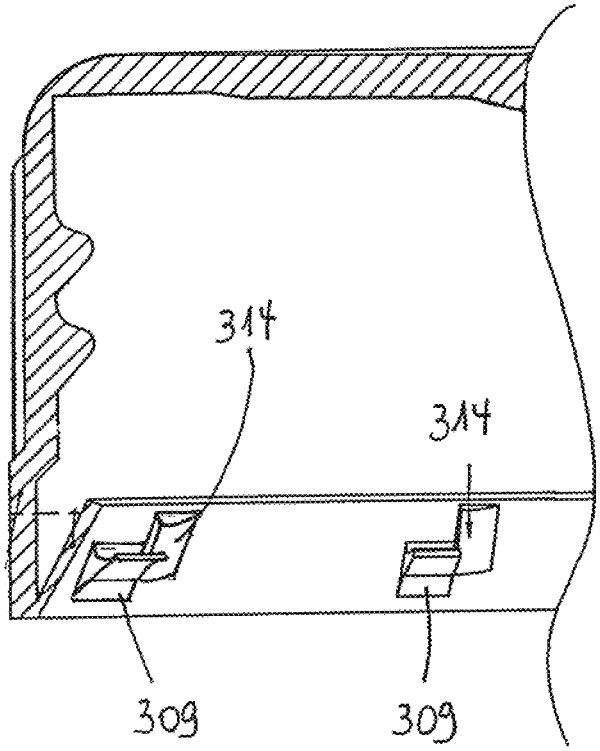

In a further example shown in FIG. 3 anti-rotational elements 314 are directly connected to projections 309.

Figure 4:
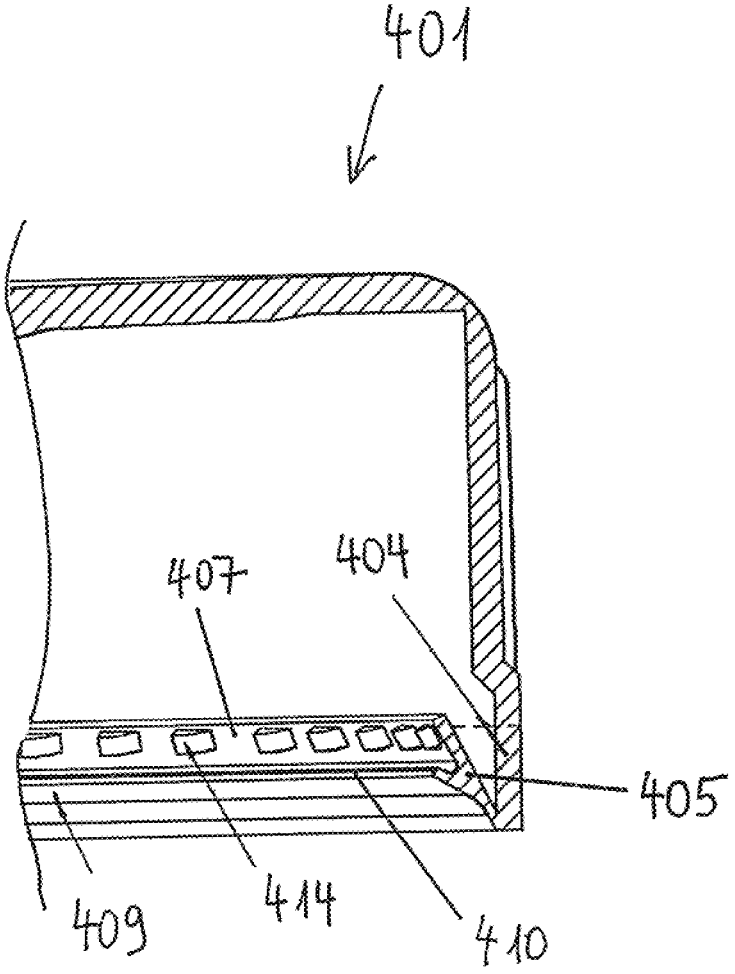

FIG. 4 shows a fourth example of a closure cap 401. A surrounding annular retaining band 405 is hingedly attached to the tamper evident band 404. On the retaining band 405 there is only one projection 409 formed as a surrounding annular band, with a circumferential engagement surface 410. The retaining band is extended by an axial extension 407, on which a plurality of anti-rotational elements 414 is arranged.

Figure 5:
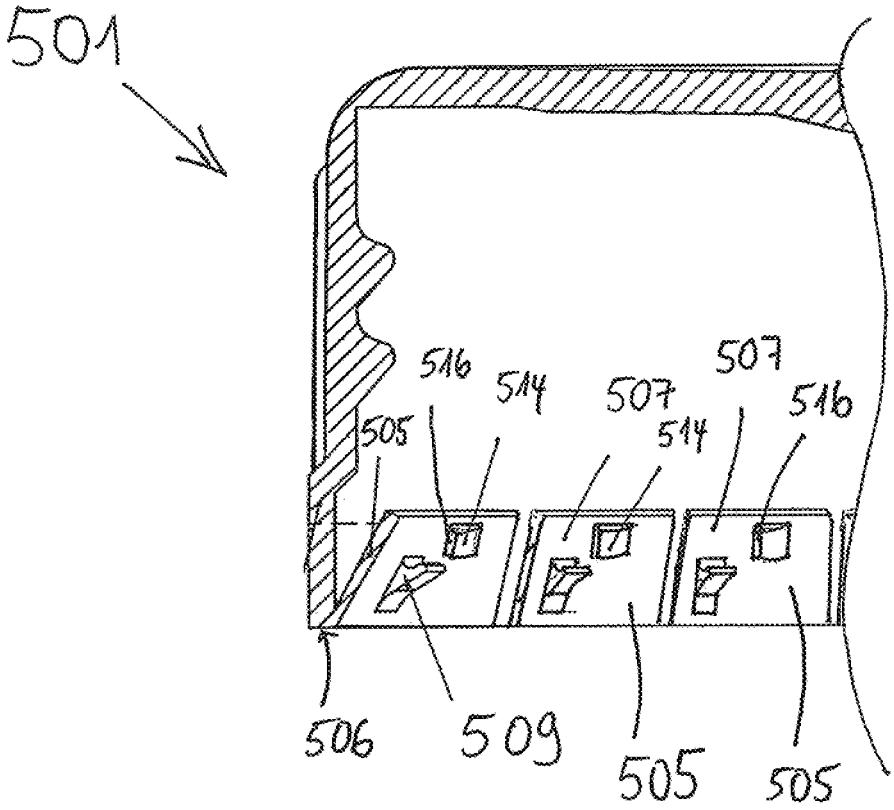

FIG. 5 shows a fifth example of a closure cap 501. Several individual retaining elements 505 are hingedly connected to the lower edge 506 of the tamper indicating band 504, each of them having an axial extension 507, a projection 509 and an anti-rotational element 514.

The anti-rotational elements 514 comprise a ratchet surface 516 which upon opening provide for a one directional retaining force if they interact with corresponding elements on the container, not shown in this figure.

Figure 6:
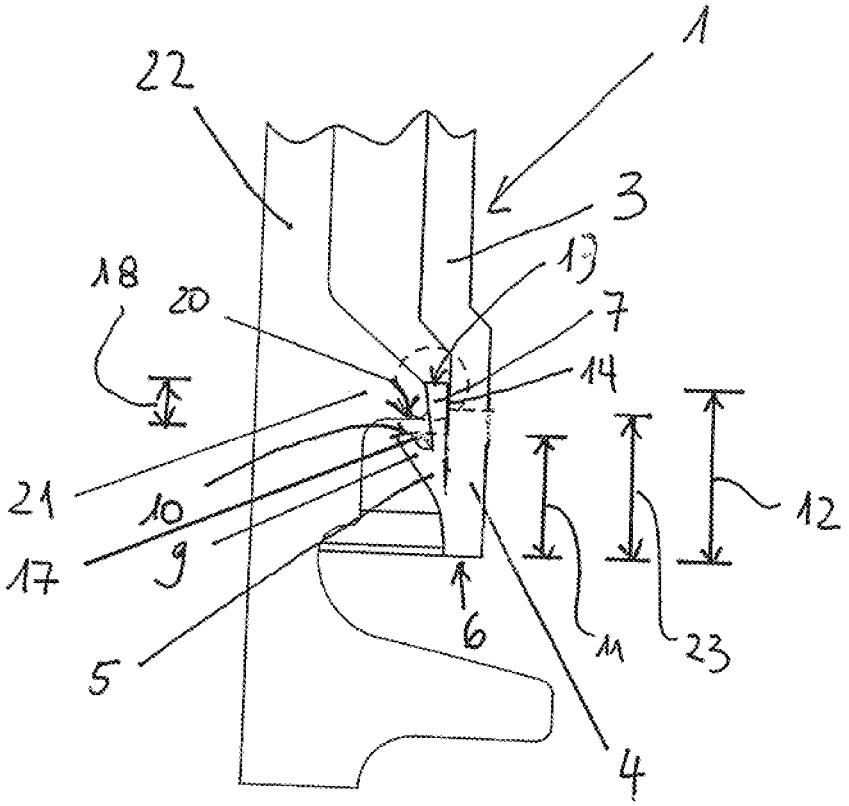
FIG. 6 is a cross section through a closure cap with a hingedly connected retaining element and a projection having a pocket applied to a container.

FIG. 6 is a view of a closure cap 1 through a cross section of a projection 9, when the closure is applied to a container.

The projection 9 is arranged on the retaining band 5, which is hingedly connected to the lower edge 6 of a tamper indicating band 4.

The projection 9 is provided with a groove 17, opened towards the top panel of the closure cap, not shown in this figure. This groove facilitates radial compression of the projection 9.

The retaining band 5 has an axial extension 7 having an axial length 18 selected such that its free edge 13 extends at least axially above the engagement surface 20 of the retaining structure 21 when the cap 1 is screwed on the container 22.

The axial distance 11 from the lower edge 6 of the tamper indicating band 4 to the closure engagement surface 10 of the at least one projection 9 is smaller than the axial distance 12 from the lower edge 6 of the tamper indicating band 4 to the free edge 19 of the axial extension 7.

When the closure cap 1 is fully screwed on the container 22, the axial extension 7 is on or above the axial level of the retaining structure 21 and clamped between the retaining structure 21 and the inner wall 14 of the closure cap 1, making downward flipping of the retaining band 5 more difficult.

The axial length 23 of the tamper indicating band 4 is smaller than the axial distance 12 between the lower edge 6 of the tamper indicating band 4 and the free edge 19 of the axial extension 7, such that the free edge 19 of the axial extension 7 is on the level of the inner wall of the cylindrical skirt 3 when the cap 1 is in the screwed on position.

The axial extension 7 thus can contact the inner surface of the tamper evident band and thus protects the line of weakness 24 from radial forces, especially during the first application of the cap 1 to the container 22.

The closures can be provided with any kind of known sealing arrangements. Typically, sealing lips or sealing liners can be provided. Furthermore, the closure can be provided with any kind of threads, particularly known screw threads. Bayonet connections also might be conceivable. The frangible connection between the skirt of the closure and the tamper evident band may be formed also in any manner known to those skilled in the art, in particular by moulded or scored bridges. Also, a continuous frangible line in the form of a thinning of the material is conceivable. The closures are typically made by injection or compression moulding from a plastic material such as polyethylene or polypropylene. Typically, the closures are used for closing containers filled with carbonated or non-carbonated beverages.

The retaining projections and circumference anti-rotational means shown in FIGS. 1 to 5 can be substantially evenly distributed along the complete circumference of the tamper evident band although only parts thereof are shown in these figures. However, other, non-symmetric arrangements also are conceivable. The projections shown in FIGS. 1 to 3 and 5 have a rectangular form when seen in a radial direction. However, other forms of the retaining projections might also be conceivable, in particular a trapezoid form with or without rounded edges when seen in the radial direction. While the projections with a groove have been shown in the embodiments of FIGS. 1 to 3 and 5 and 6, projections having a flat surface, i.e. a surface substantially lying in a plane perpendicular to the axis of the closure are conceivable.

While several embodiments have been shown in FIG. 1 to 6, the invention is not limited to these embodiments. In particular, specific combinations of elements shown in these figures are still within the scope of the present invention. The number of projections or anti-rotational elements can be selected in accordance with practical needs. Typically, there can be around eight to sixteen projections associated with eight to sixteen anti-rotational elements. A larger number of anti-rotational elements having a smaller size is conceivable as well.

Figure 7:
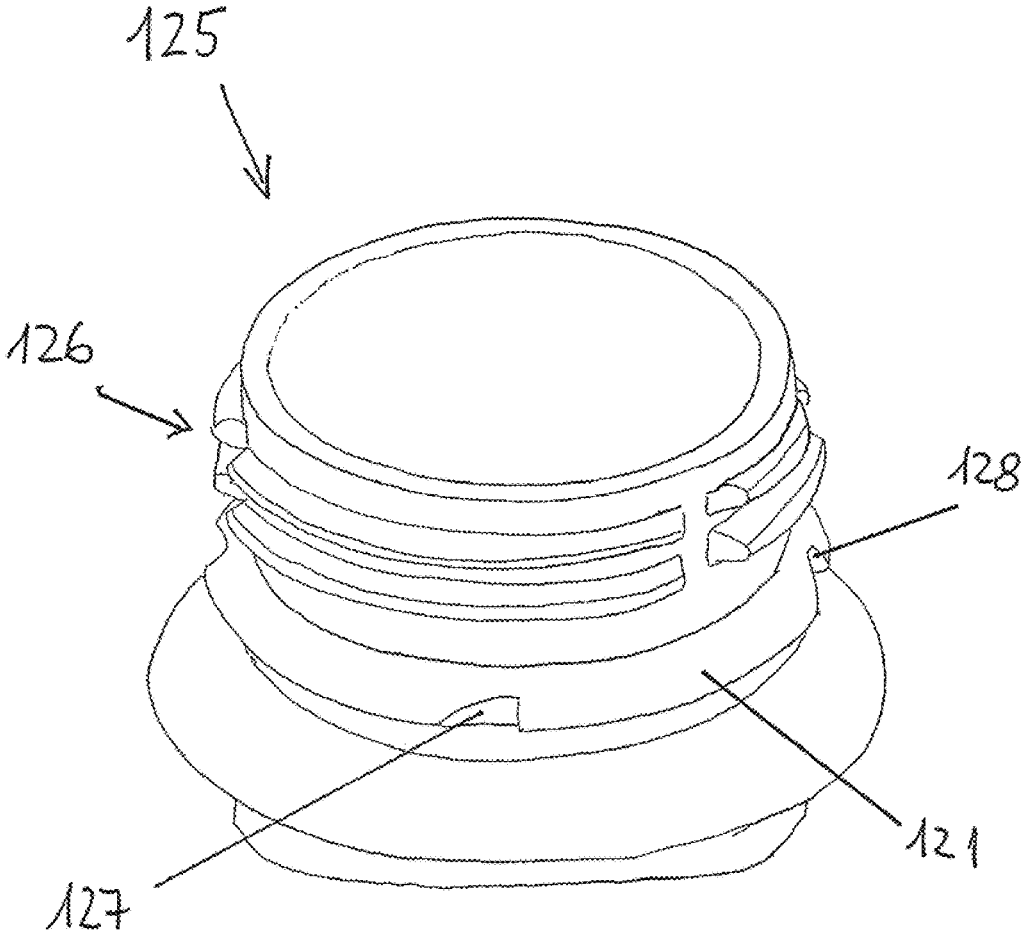
FIG. 7 is a perspective view of a first example of a container finish.

FIG. 7 is a perspective view of a first example of a container finish 125. The container finish has a retaining structure 121 located below a threaded section 126.

On the retaining structure 121 there are equally distributed stopper elements formed as recesses 127, which have a ratchet surfaces 128 adapted to engage a corresponding surface of an anti-rotational element on the closure cap. This container finish can be used in combination with the embodiments shown in FIG. 2 to 6. For the closure shown in FIG. 1, a standard container finish can be used such as a PCO finish.

Figure 8:
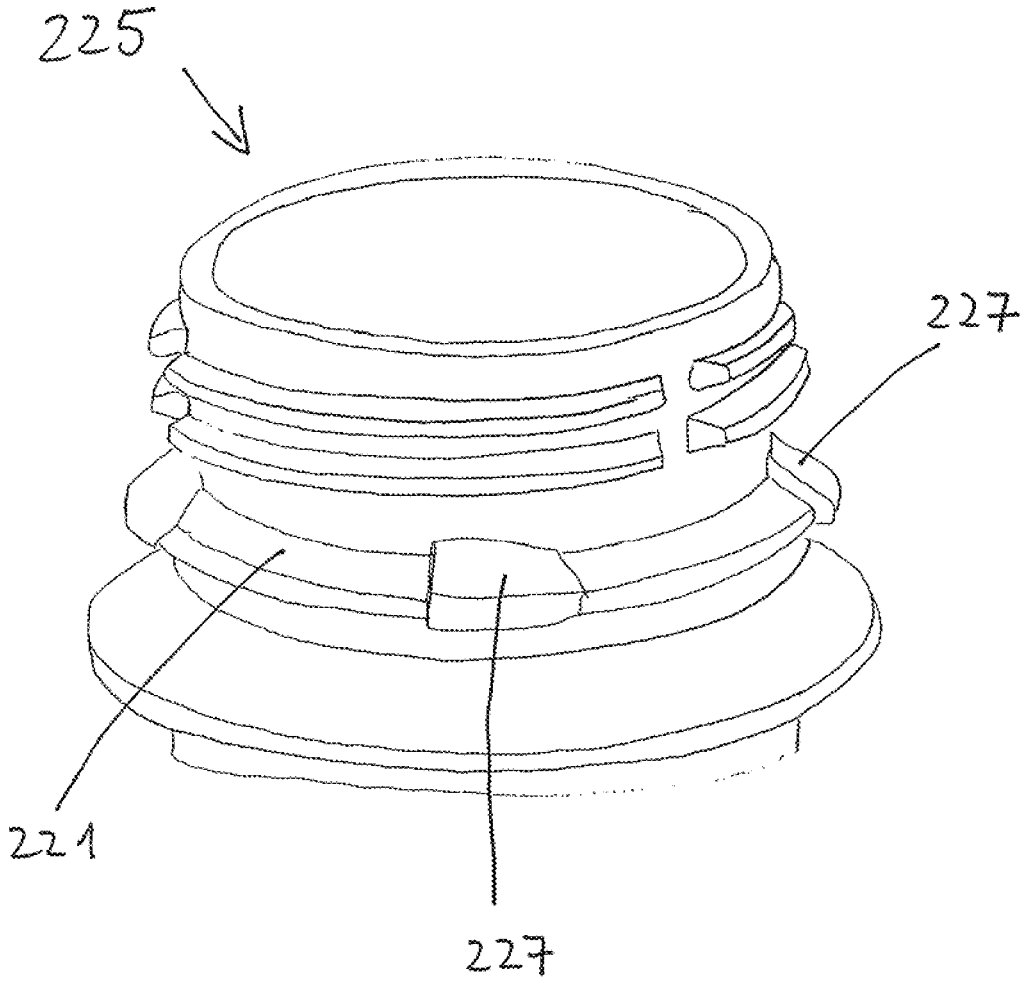
FIG. 8 is a perspective view of a second example of a container finish.

FIG. 8 shows a second example of a container finish 225, having stopping elements 227, formed as projections on the retaining structure 221. This finish can be used for any of the closures shown in FIG. 2, 3, 5 or 6.

Figure 9:
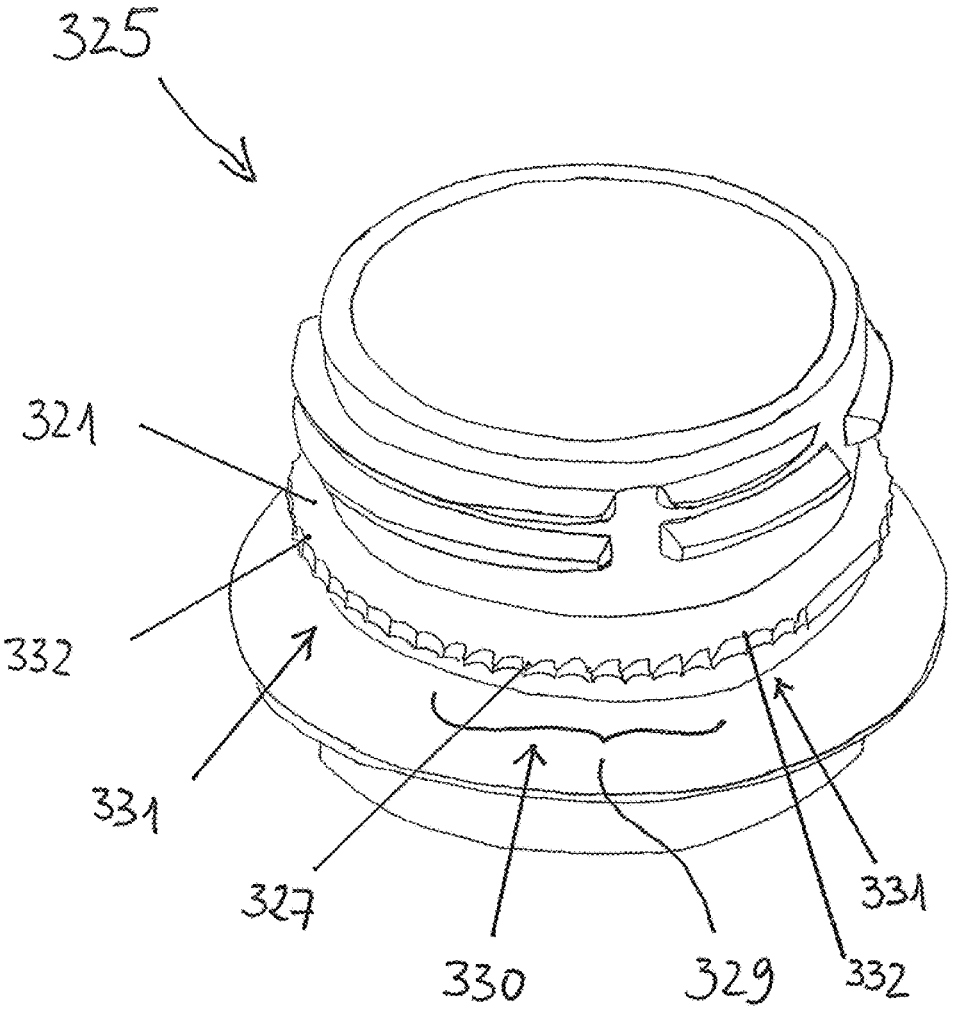
FIG. 9 is a perspective view of a third example of a container finish.

FIG. 9 is a perspective view of a third example of a container finish 325.

On the retaining structure 321 of the container finish 325 there is a sectional area 329, where a first group 330 of stopper elements 327 is located with ratchet surfaces. This first group is framed by second groups 331 of projections 332, having basically the same radial extension than the stopper elements 327, but presenting no ratchet surfaces.

Figure 10:
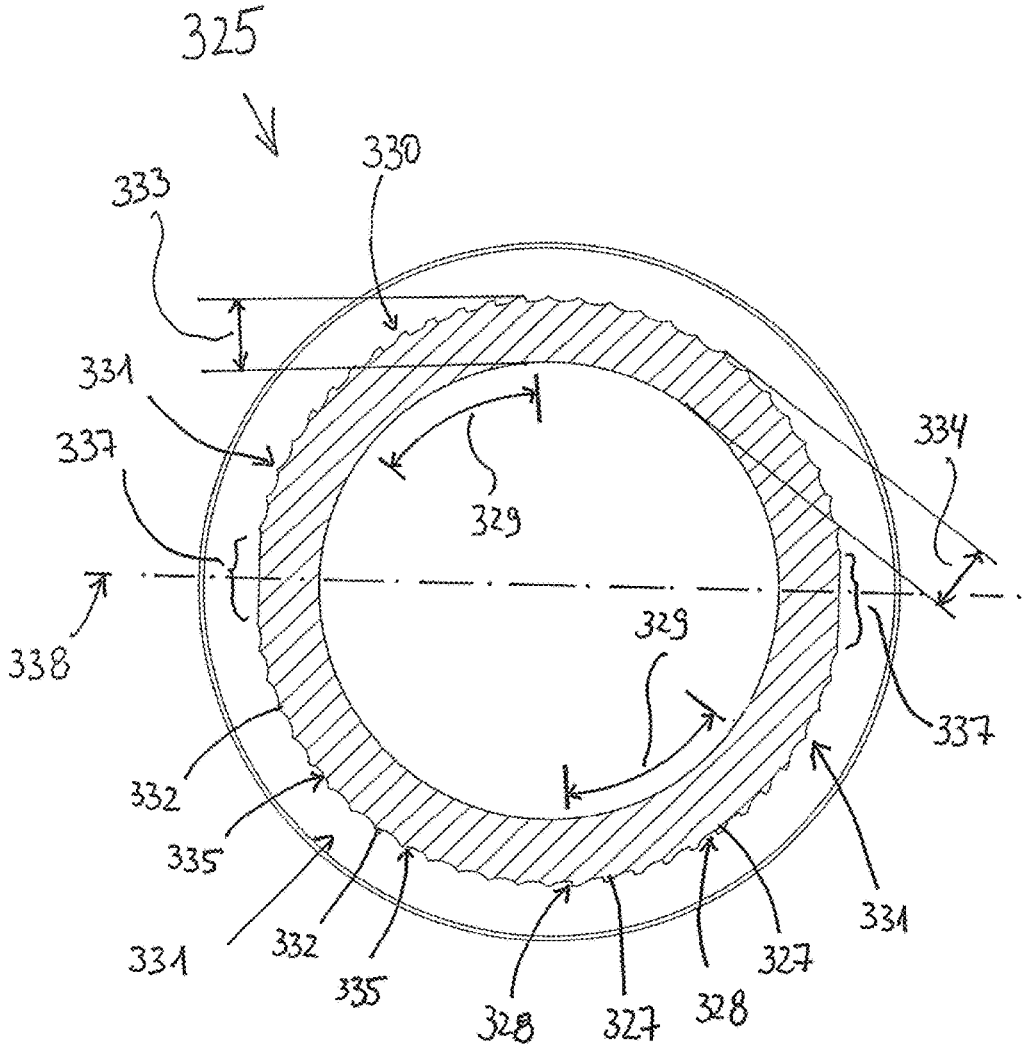
FIG. 10 is a top plan view of a container finish according FIG. 9.

FIG. 10 is a top plan view of a container finish 325 according FIG. 9.

Two first groups of stopper elements 327, each stopper element 327 having a ratchet surface 328 in circumferential direction, are arranged in a limited section 329 of the circumference of the container finish 325.

Second groups 331 of projections 332 without ratchet surfaces are arranged in further limited sections of the circumference.

The maximal radial extension 333 of the stopper elements 327 is basically equal to the maximal radial extension 334 of the projections 332.

All surfaces, in particular radial surfaces 335 of the projections 332, radial surfaces 336 of the stopper elements 327 and ratchet surfaces 328 are formed in such a way that de-moulding (i.e. separation of the mould halves from a de-moulding plane 338) is easily possible without damaging any of the surfaces. In particular, any normal to any surface of the ratchets or projections should form an angle of less than 90° as compared to the direction of separation of the moulds (which is perpendicular to the de-moulding plane 338). Typically, surfaces also may be formed as concave surfaces.

In the vicinity 337 of the demoulding plane 338 there are thus neither stopper elements nor projections.

The invention claimed is:

1. A closure cap comprising a top panel, a cylindrical skirt extending from the periphery of the top panel, and a tamper indicating band, frangibly connected to an open end of the skirt at a line of weakness, wherein the tamper indicating band at a lower edge thereof comprises a hingedly connected annular retaining band, which extends radially inwardly and axially towards the top panel when the cap is in a screwed on position, the annular retaining band having at least one projection arranged on the retaining band with a closure engagement surface, the at least one projection having a groove to facilitate radial compression of the projection, the at least one projection extending radially towards an inside of the cap so as to engage under an engagement surface of a retaining structure arranged on a container neck when the cap is in the screwed on position, wherein the annular retaining band has at least one axial extension, having an axial length selected such that a free edge of the at least one axial extension extends above an axial level of the engagement surface of the retaining structure, the at least one axial extension being clamped between the retaining structure and an inner wall of the closure cap such that the at least one axial extension contacts the inner wall of the closure cap above the line of weakness to shield and protect the line of weakness from radial forces when the cap is in the screwed on position, wherein an axial distance from the lower edge of the tamper indicating band to the closure engagement surface of the at least one projection is smaller than an axial distance from the lower edge of the tamper indicating band to the free edge of the axial extension, and wherein the annular retaining band comprises at least one anti-rotational element adapted to engage a corresponding element on the container neck in a circumferential direction to reduce an opening angle necessary for breaking the tamper indicating band at the line of weakness such that the line of weakness breaks before a sealing of the closure is released, the at least one anti-rotational element being arranged on the annular retaining band at an axial level that is at least partially above the at least one projection.

2. The closure cap according to claim 1, wherein the at least one anti-rotational element has a ratchet surface adapted to engage with a corresponding surface on the container neck at an axial level above the engagement surface of the retaining structure when the cap is in the screwed on position.

3. A closure cap, comprising a top panel, a cylindrical skirt extending from the periphery of the top panel, and a tamper indicating band, having an upper edge frangibly connected to an open end of the skirt at a line of weakness, wherein the tamper indicating band has at a lower edge at least one hingedly connected retaining element, which extends radially inwardly and towards the top panel when the closure cap is in a screwed on position, wherein at least one projection with a closure engagement surface is arranged on at least one of the at least one retaining elements, the at least one projection having a groove to facilitate radial compression of the projection, the at least one projection extending radially towards an inside of the closure cap so as to engage under an engagement surface of a retaining structure arranged on a container neck when the closure cap is in the screwed on position, wherein at least one of the retaining elements has at least one axial extension having an axial length selected such that a free edge extends axially above the retaining structure, the at least one axial extension being clamped between the retaining structure and an inner wall of the skirt such that the at least one axial extension contacts the inner wall of the skirt and partially transfers radial forces to the inner wall of the skirt above the line of weakness, the radial forces being applied by the at least one retaining element when the at least one projection axially passes along the retaining structure, the partial transfer of radial forces to the inner wall of the skirt above the line of weakness facilitates shielding and protecting the line of weakness from the radial forces directed to the inner wall of the tamper indicating band when the closure cap is in the screwed on position, an axial distance from the lower edge of the tamper indicating band to the closure engagement surface of the at least one projection being smaller than an axial distance from the lower edge of the tamper indicating band to the free edge of the axial extension, and wherein at least one anti-rotational element is arranged on at least one of the at least one axial extensions at an axial level tat is at least partially above the at least one projection when the closure cap is in the screwed on position, the at least one anti-rotational element having an engagement surface which engages, in a circumferential direction, a corresponding element of the retaining structure at an axial level above the engagement surface of the retaining structure to reduce an opening angle necessary for breaking the tamper indicating band at the line of weakness such that the line of weakness breaks before a sealing of the closure cap is released.

4. The closure cap according to claim 3, wherein said at least one retaining element comprises a plurality of retaining elements, and wherein each of the retaining elements comprises at least one axial extension.

5. The closure cap according to claim 3, wherein said at least one retaining element comprises a plurality of retaining elements, and wherein each of the retaining elements comprises at least one projection.

6. The closure cap according to claim 3, wherein said at least one retaining element comprises a plurality of retaining elements, and wherein each of the retaining elements comprises at least one anti-rotational element.

7. The closure cap according to claim 3, wherein the axial length of the tamper indicating band is smaller than the axial distance between the lower edge of the tamper indicating band and the free edge of the axial extension, such that the free edge of the axial extension extends to the level of the inner wall of the cylindrical skirt when the cap is in the screwed on position.

8. The closure cap according to claim 3, wherein at least one anti-rotational element has a ratchet surface adapted to engage with a corresponding surface on the container neck which is located on the retaining structure axially above the engagement surface of the retaining structure and above the at least one projection of the at least one retaining element when the cap is in the screwed on position.

9. A closure cap, comprising a top panel, a cylindrical skirt defining a longitudinal axis of the cap and extending from the periphery of the top panel, a tamper indicating band, having an upper edge frangibly connected to an open end of the skirt at a line of weakness, at least one retaining element being hingedly connected to a lower edge of the tamper indicating band, the at least one retaining element extending radially inwardly and axially towards the top panel when the closure cap is in a screwed on position, the at least one retaining element having at least one projection with a closure engagement surface, the at least one projection having a groove to facilitate radial compression of the projection, the projection extending radially inwardly towards an inside of the closure cap so as to engage under an engagement surface of a retaining structure arranged on a container neck when the closure cap is in the screwed on position, the at least one of the retaining element has at least one axial extension that extends axially towards the top panel, the at least one extension having an axial length selected such that a free edge of the at least one extension is located axially above the engagement surface of the retaining structure and the line of weakness, the at least one axial extension being clamped between the retaining structure and the inner wall of the closure cap such that, at an axial level above the engagement surface of the retaining structure, the at least one axial extension mates with the retaining structure and the inner wall of the skirt to shield and protect the line of weakness from radial forces when the closure cap is in the screwed on position, an axial distance from the lower edge of the tamper indicating band to the closure engagement surface of the at least one projection being smaller than an axial distance from the lower edge of the tamper indicating band to the free edge of the axial extension, and at least one anti-rotational element being arranged on the axial extension axially closer to the free edge thereof than the at least one projection such that the at east one anti-rotational element engages, in a circumferential direction, a corresponding element of the retaining structure which is located at an axial level above the engagement surface of the retaining structure when the cap is in the screwed on position to reduce an opening angle necessary for breaking the tamper indicating band at the line of weakness such that the line of weakness breaks before a sealing of the closure cap is released.

* * * * *